US009353934B1

(12) United States Patent
Rudloff

(10) Patent No.: US 9,353,934 B1
(45) Date of Patent: May 31, 2016

(54) STRUCTURE LIGHTING ASSEMBLY

(71) Applicant: Kortney Rudloff, Sheridan, WY (US)

(72) Inventor: Kortney Rudloff, Sheridan, WY (US)

( * ) Notice: Subject to any disclaimer, the term of this patent is extended or adjusted under 35 U.S.C. 154(b) by 582 days.

(21) Appl. No.: 13/691,953

(22) Filed: Dec. 3, 2012

(51) Int. Cl.
*F21V 21/00* (2006.01)
*F21V 21/08* (2006.01)

(52) U.S. Cl.
CPC ..... *F21V 21/0816* (2013.01)

(58) Field of Classification Search
CPC . F21V 19/0005; F21V 19/004; F21V 19/006; F21V 21/005; F21V 21/008; F21V 21/0816
USPC ..... 362/391, 153.1, 249.16
See application file for complete search history.

(56) References Cited

U.S. PATENT DOCUMENTS

| | | | | |
|---|---|---|---|---|
| 4,128,863 | A | 12/1978 | Premetz | |
| 4,774,646 | A | 9/1988 | L'Heureux | |
| 5,141,192 | A | 8/1992 | Adams | |
| 5,142,461 | A | 8/1992 | Nugent | |
| 5,404,279 | A | 4/1995 | Wood | |
| 5,518,214 | A * | 5/1996 | Spencer | 248/205.2 |
| 5,594,628 | A | 1/1997 | Reuter et al. | |
| 5,813,751 | A * | 9/1998 | Shaffer | 362/249.08 |
| 5,961,202 | A | 10/1999 | Lin | |
| D424,720 | S | 5/2000 | Nichols, Jr. | |
| 7,080,925 | B1 * | 7/2006 | Rushing | 362/249.01 |
| 2010/0232151 | A1 | 9/2010 | Jones | |

* cited by examiner

*Primary Examiner* — Sharon Payne

(57) ABSTRACT

A light holding assembly facilitates installation and removal of decorative light strings on a structure. The assembly includes a panel having an upper section and a lower section. The lower section is selectively separable from the upper section. A plurality of apertures extends through the upper section of the panel wherein the upper section of the panel is configured for being coupled to a structure by insertion of connectors through the apertures. A plurality of straps is coupled to the lower section of the panel. The straps are selectively formed into loops wherein the lower section of the panel is configured for supporting a string of lights extending through the loops.

6 Claims, 3 Drawing Sheets

STRUCTURE LIGHTING ASSEMBLY

BACKGROUND OF THE DISCLOSURE

Field of the Disclosure

The disclosure relates to light holding devices and more particularly pertains to a new light holding device for facilitating installation and removal of decorative light strings on a structure.

SUMMARY OF THE DISCLOSURE

An embodiment of the disclosure meets the needs presented above by generally comprising a panel having an upper section and a lower section. The lower section is selectively separable from the upper section. A plurality of apertures extends through the upper section of the panel wherein the upper section of the panel is configured for being coupled to a structure by insertion of connectors through the apertures. A plurality of straps is coupled to the lower section of the panel. The straps are selectively formed into loops wherein the lower section of the panel is configured for supporting a string of lights extending through the loops.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
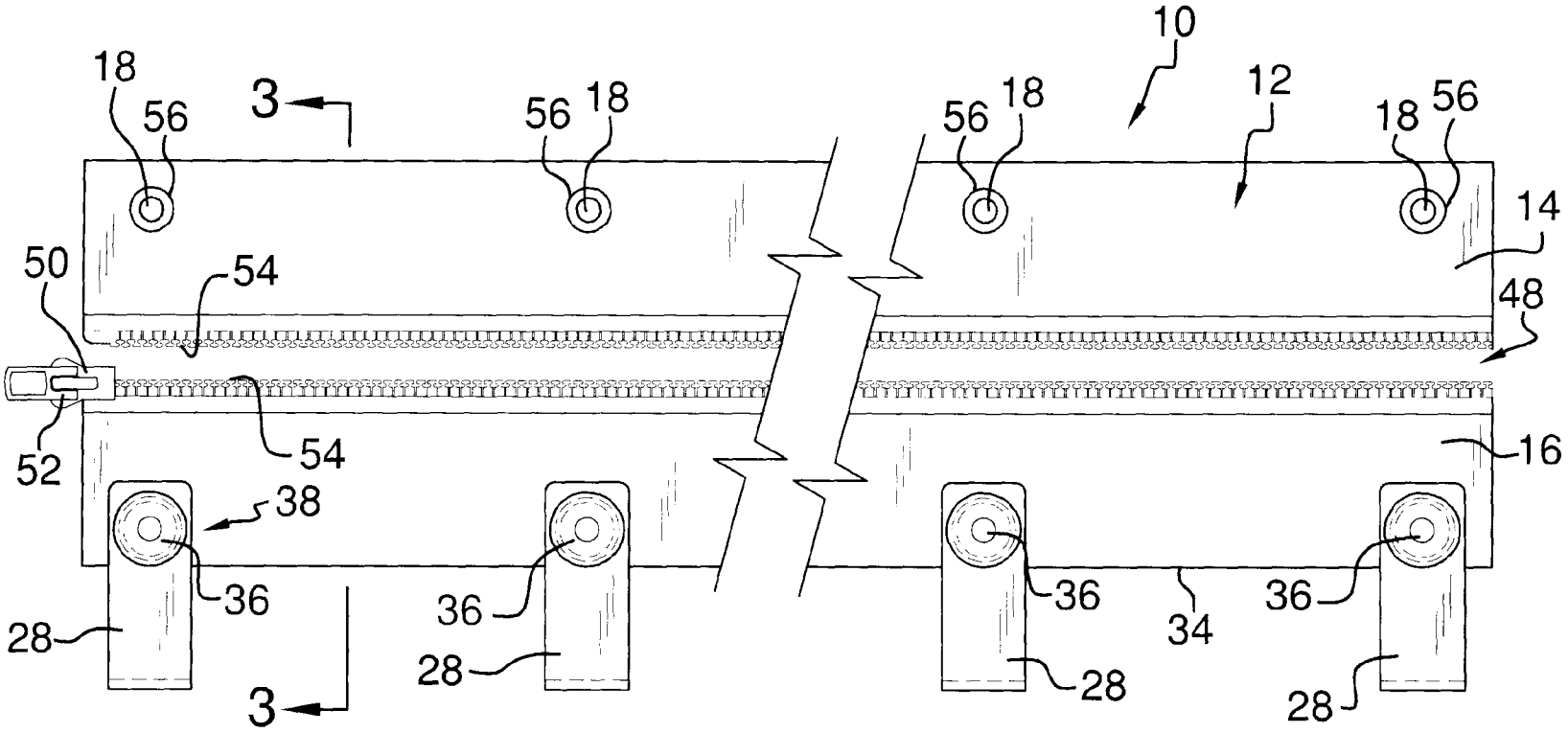
FIG. 1 is a front view of a light holding assembly according to an embodiment of the disclosure.
Figure 2:
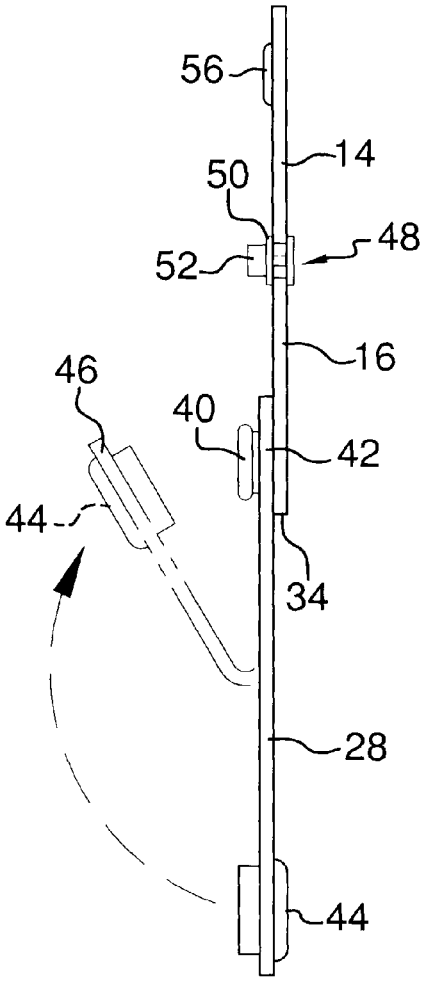
FIG. 2 is a side view of an embodiment of the disclosure.
Figure 3:
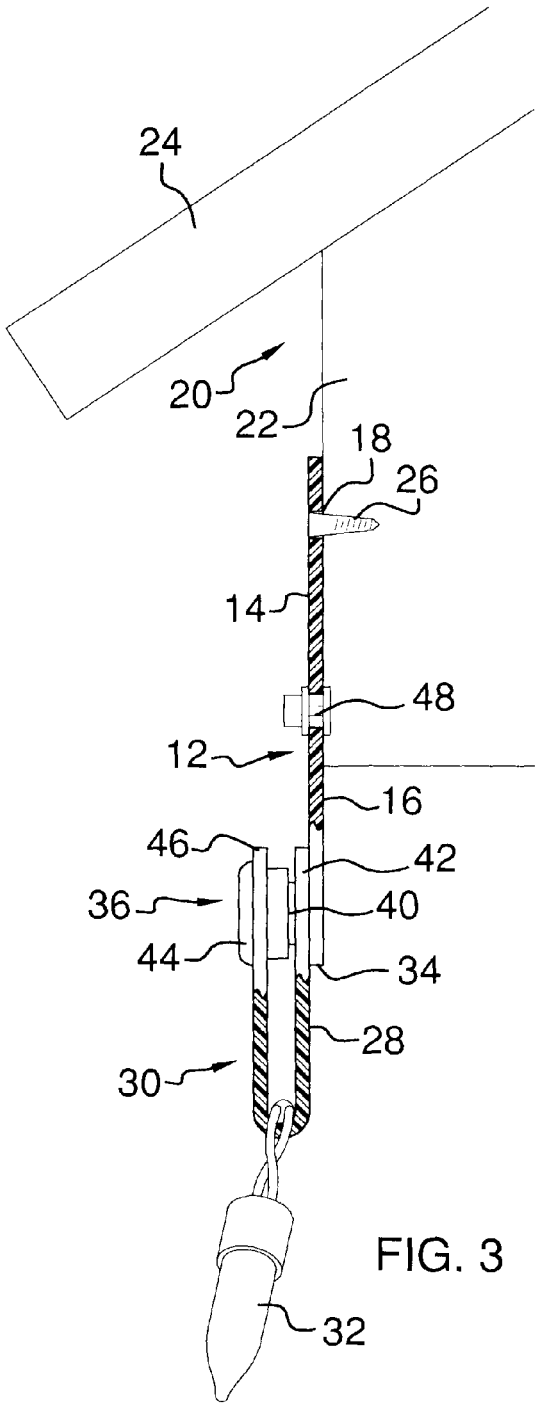
FIG. 3 is a cross-sectional view of an embodiment of the disclosure taken along line 3-3 of FIG. 1 and shown in use.
Figure 4:
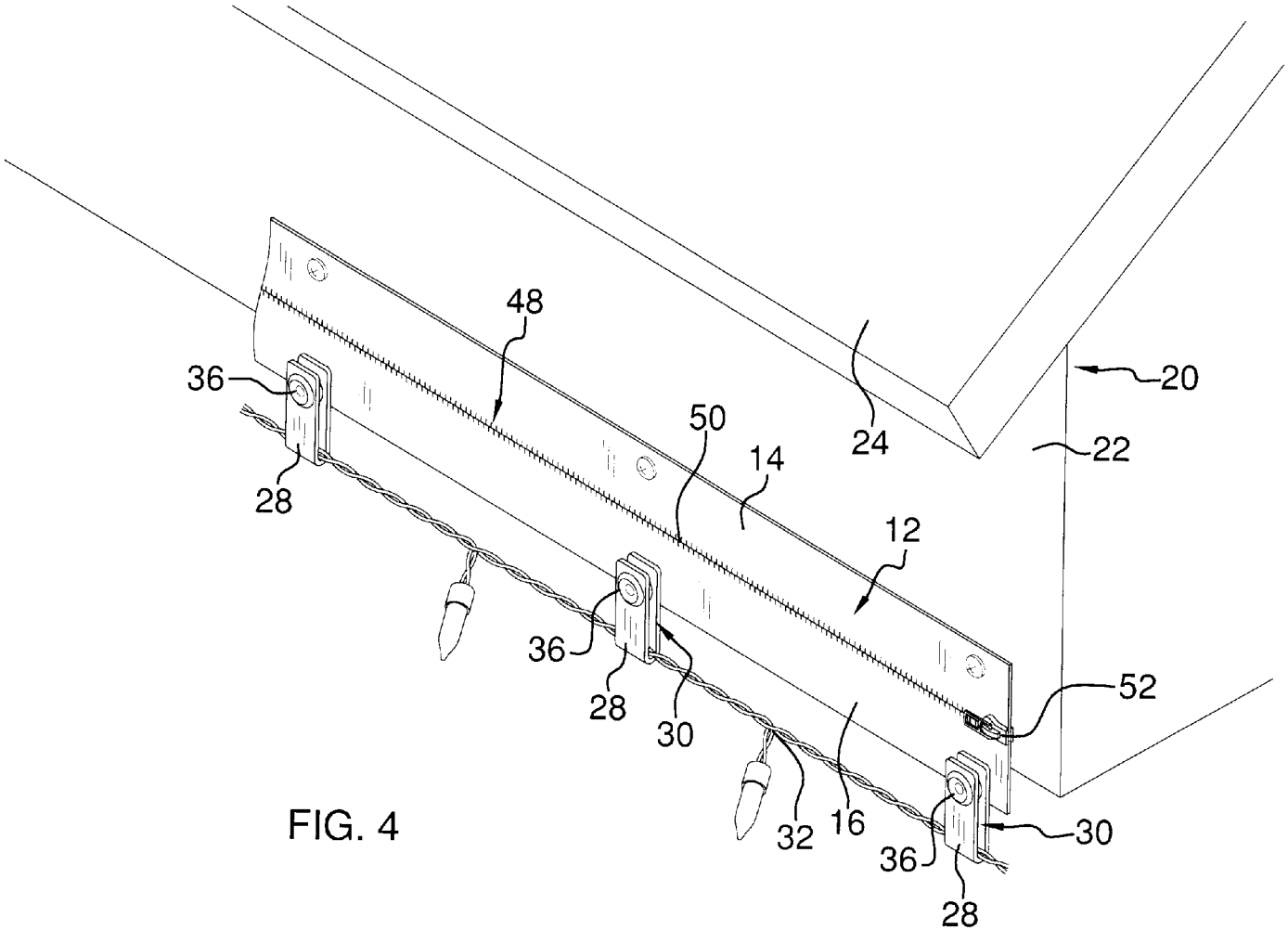
FIG. 4 is a top front side perspective view of an embodiment of the disclosure.

With reference now to the drawings, and in particular to FIGS. 1 through 4 thereof, a new light holding device embodying the principles and concepts of an embodiment of the disclosure and generally designated by the reference numeral 10 will be described.

As best illustrated in FIGS. 1 through 4, the light holding assembly 10 generally comprises an elongated panel 12 having an elongated upper section 14 and an elongated lower section 16. The lower section 16 is selectively separable from the upper section 14. A plurality of apertures 18 extends through the upper section 14 of the panel 12 wherein the upper section 14 of the panel 12 is configured for being coupled to a structure 20 such as a fascia 22 extending from a roof 24 by insertion of connectors 26 through the apertures 18. Grommets 56 may be used to reinforce each aperture 18 allowing the upper section 14 of the panel 12 to be left on the structure 20 year round. A plurality of straps 28 is coupled to the lower section 16 of the panel 12. The straps 28 are selectively formed into a plurality of loops 30 such that the lower section 16 of the panel 12 is configured for supporting a string of lights 32 extending through the loops 30. Each of the loops 30 may extend downwardly from a bottom edge 34 of the lower section 16 of the panel 12.

A plurality of snaps 36 may be provided. Each snap 36 is coupled to an associated one of the straps 28 wherein the associated strap 28 forms the loop 30 when the snap 36 is in a closed position 38. Each snap 36 has a first section 40 coupling a first end 42 of the strap 28 to the lower section 16 of the panel 12. Each snap 36 further has a second section 44 coupled to a second end 46 of the strap 28. The first section 40 of the snap 36 is selectively couplable to the second section 44 of the snap 36 to form the loop 30.

A coupler 48 extends between the upper section 14 of the panel 12 and the lower section 16 of the panel 12. The coupler 48 removably couples the upper section 16 of the panel 12 to the lower section 16 of the panel 12. The coupler 48 may be a zipper 50 having a slidable head 52 and a plurality of teeth 54 extending along a full length of the panel 12. The zipper 50 may be constructed of a durable weather proof material.

In use, the upper section 14 of the panel 12 is coupled to the structure 20. The string of lights 32 may be coupled to the lower section 16 of the panel 12 by opening each loop 30 or stringing the lights 32 through the loops 30. The lower section 16 of the panel 12 is then coupled to the upper section 14 of the panel 12 when a person desires to display the lights 32 on the structure 20. The snaps 36 facilitate replacement of the lights 32 without having to fully remove the lower section 16 of the panel 12 if desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A light holding assembly comprising:

a panel having an upper section and a lower section, said lower section being selectively separable from said upper section;

a plurality of apertures extending through said upper section of said panel wherein said upper section of said panel is configured for being coupled to a structure by insertion of connectors through said apertures; and a plurality of straps coupled to said lower section of said panel, said straps being selectively formed into a plurality of loops wherein said lower section of said panel is configured for supporting a string of lights extending through said loops, each of said loops extending downwardly from a bottom edge of said lower section of said panel.

2. The assembly of claim 1, further comprising a plurality of snaps, each snap being coupled to an associated one of said straps wherein said associated strap forms said loop when said snap is in a closed position.

3. The assembly of claim 2, further comprising each said snap having a first section coupling a first end of said strap to said lower section of said panel, each said snap further having a second section coupled to a second end of said strap, said first section of said snap being selectively couplable to said second section of said snap to form said loop.

4. The assembly of claim 1, further comprising a coupler extending between said upper section of said panel and said lower section of said panel, said coupler removably coupling said upper section of said panel to said lower section of said panel.

5. The assembly of claim 4, further comprising said coupler being a zipper.

6. A light holding assembly comprising:

a panel having an upper section and a lower section, said lower section being selectively separable from said upper section;

a plurality of apertures extending through said upper section of said panel wherein said upper section of said panel is configured for being coupled to a structure by insertion of connectors through said apertures;

a plurality of straps coupled to said lower section of said panel, said straps being selectively formed into a plurality of loops wherein said lower section of said panel is configured for supporting a string of lights extending through said loops, each of said loops extending downwardly from a bottom edge of said lower section of said panel;

a plurality of snaps, each snap being coupled to an associated one of said straps wherein said associated strap forms said loop when said snap is in a closed position, each said snap having a first section coupling a first end of said strap to said lower section of said panel, each said snap further having a second section coupled to a second end of said strap, said first section of said snap being selectively couplable to said second section of said snap to form said loop; and a coupler extending between said upper section of said panel and said lower section of said panel, said coupler removably coupling said upper section of said panel to said lower section of said panel, said coupler being a zipper.

* * * * *